US008653724B2

(12) United States Patent
Suzuki

(10) Patent No.: US 8,653,724 B2
(45) Date of Patent: Feb. 18, 2014

(54) SPARK PLUG FOR INTERNAL COMBUSTION ENGINE HAVING A GROUND ELECTRODE WITH A PROTRUSION HAVING IMPROVED EROSION RESISTANCE AND METHOD OF MANUFACTURING SAME

(75) Inventor: Akira Suzuki, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 99 days.

(21) Appl. No.: 13/138,581

(22) PCT Filed: Mar. 8, 2010

(86) PCT No.: PCT/JP2010/001618
§ 371 (c)(1),
(2), (4) Date: Sep. 8, 2011

(87) PCT Pub. No.: WO2010/103790
PCT Pub. Date: Sep. 16, 2010

(65) Prior Publication Data

US 2011/0316408 A1 Dec. 29, 2011

(30) Foreign Application Priority Data

Mar. 11, 2009 (JP) ..... 2009-057242

(51) Int. Cl.
*H01J 13/20* (2006.01)
*H01J 9/00* (2006.01)

(52) U.S. Cl.
USPC ..... 313/141; 445/7

(58) Field of Classification Search
USPC ..... 313/118, 140, 141; 445/7
See application file for complete search history.

(56) References Cited

U.S. PATENT DOCUMENTS

2002/0130602 A1 9/2002 Kanao et al. ..... 313/141
2003/0155849 A1 8/2003 Hori ..... 313/141

(Continued)

FOREIGN PATENT DOCUMENTS

JP 62-50430 3/1987 ..... C22C 19/05
JP 2003-317896 11/2003 ..... H01T 13/39

(Continued)

OTHER PUBLICATIONS

International Search Report for International Application No. PCT/JP2010/001618, May 25, 2010.

(Continued)

*Primary Examiner* — Joseph L Williams
(74) *Attorney, Agent, or Firm* — Kusner & Jaffe

(57) ABSTRACT

An objective is to provide a spark plug in which a ground electrode has a protrusion formed from the same material as that used to form the ground electrode and the heat transfer performance of the protrusion is improved to thereby improve erosion resistance. A spark plug 1 includes a rodlike center electrode 5 extending in the direction of an axis CL1; a substantially cylindrical insulator 2 provided externally of the outer circumference of the center electrode 5; a substantially cylindrical metallic shell 3 provided externally of the outer circumference of the insulator 2; and a ground electrode 27 extending from a front end portion 26 of the metallic shell 3 and forming a spark discharge gap 35 between a distal end portion thereof and a front end portion of the center electrode 5. A protrusion 28 projecting toward the center electrode 5 and forming the spark discharge gap 35 in cooperation with the front end portion of the center electrode 5 is formed at the distal end portion of the ground electrode 27 from the same material as that used to form the ground electrode 27. At least the protrusion 28 has an average crystal grain size of 20 μm to 200 μm inclusive.

8 Claims, 6 Drawing Sheets

(56) References Cited

U.S. PATENT DOCUMENTS

| | | | | |
|---|---|---|---|---|
| 2006/0220511 | A1 | 10/2006 | Hanashi et al. | 313/141 |
| 2007/0159046 | A1 | 7/2007 | Yoshimoto et al. | 313/141 |
| 2009/0009048 | A1 | 1/2009 | Yoshimoto et al. | 313/142 |
| 2010/0289397 | A1 | 11/2010 | Hanashi et al. | 313/141 |
| 2012/0190266 | A1 | 7/2012 | Hanashi et al. | 445/7 |

FOREIGN PATENT DOCUMENTS

| | | | |
|---|---|---|---|
| JP | 2005-002383 | 1/2005 | C22F 1/04 |
| JP | 2006-269436 | 10/2006 | H01T 13/39 |
| JP | 2006-286469 | 10/2006 | H01T 13/20 |
| JP | 2007-165291 | 6/2007 | H01T 13/39 |
| JP | 2007-173729 | 7/2007 | H01L 33/00 |
| JP | 2009-16278 | 1/2009 | H01T 13/39 |
| JP | 2009-54579 | 3/2009 | H01T 13/32 |
| WO | WO 2009/017187 | 2/2009 | H01T 21/02 |

OTHER PUBLICATIONS

Notification of Provisional Refusal (dated Jan. 21, 2013) issued in connection with corresponding Korean Patent Application No. 10-2011-7023747, with English translation.

Search Report (dated Oct. 10, 2013) issued in connection with corresponding European Patent Application No. 10750547.1.

Website print out of: "University of Virginia: Chapter 11. Thermal Processing of Metal Alloys," http://web.archive.org/web/20071118113441/http://www.virginia.edu/bohr/mse209/chapter11.htm, print out date, Nov. 30, 2013.

SPARK PLUG FOR INTERNAL COMBUSTION ENGINE HAVING A GROUND ELECTRODE WITH A PROTRUSION HAVING IMPROVED EROSION RESISTANCE AND METHOD OF MANUFACTURING SAME

FIELD OF THE INVENTION

The present invention relates to a spark plug for use in an internal combustion engine and to a method of manufacturing the same.

BACKGROUND OF THE INVENTION

Generally, a spark plug for use in an internal combustion engine, such as an automotive engine, is configured to ignite an air-fuel mixture supplied into a combustion chamber of the internal combustion engine, through generation of sparks across a spark discharge gap between a center electrode and a ground electrode.

In recent years, in order to cope with exhaust gas regulations and to improve fuel economy, lean-burn engines, direct-injection engines, low-emission engines, and like internal combustion engines have been actively developed. These internal combustion engines require a spark plug higher in ignition performance than conventional spark plugs.

A known spark plug having excellent ignition performance has a ground electrode on which a protrusion is provided. An example of such a spark plug is configured such that a noble metal tip of an iridium alloy, a platinum alloy, or the like, which exhibits excellent erosion resistance, is welded to the ground electrode, thereby forming the protrusion. For example, see Japanese Patent Application Laid-Open (kokai) No. 2003-317896, hereinafter "Patent Document 1").

However, a noble metal tip of an iridium alloy, a platinum alloy, or the like is expensive. Thus, manufacturing cost may increase.

Thus, there is proposed a technique for working on the ground electrode itself so as to form the protrusion made of the same material as that used to form the ground electrode. For example, see Japanese Patent Application Laid-Open (kokai) No. 2006-286469 "Patent Docuement 2").

SUMMARY OF THE INVENTION

Problems to be Solved by the Invention

However, the protrusion protruding from the ground electrode encounters difficulty in transferring heat, potentially resulting in a deterioration in erosion resistance. In the case where the protrusion is formed of a noble metal tip of an iridium alloy, a platinum alloy, or the like as described in the above Patent Document 1, even though heat transfer is rather poor, the protrusion can maintain erosion resistance to such an extent as to be good for use, since a noble metal alloy has excellent erosion resistance. However, in the case where the ground electrode itself is worked to form the protrusion as described in the above Patent Document 2, if heat transfer is poor, the protrusion may be sharply eroded, since an alloy used to form the ground electrode is inferior in erosion resistance to a noble metal alloy.

The present invention has been conceived in view of the above circumstances, and an object of the invention is to provide a spark plug for an internal combustion engine in which a ground electrode has a protrusion formed from the same material as that used to form the ground electrode and the heat transfer performance of the protrusion is improved to thereby improve erosion resistance, as well as a method of manufacturing the spark plug.

Means for Solving the Problems

Configurations suitable for achieving the above object will next be described in itemized form. If needed, actions and effects peculiar to the configurations will be described additionally.

Configuration 1: A spark plug for an internal combustion engine according to the present configuration comprises a rodlike center electrode extending in a direction of an axis; a substantially cylindrical insulator provided externally of an outer circumference of the center electrode; a substantially cylindrical metallic shell provided externally of an outer circumference of the insulator; and a ground electrode extending from a front end portion of the metallic shell and forming a gap between a distal end portion thereof and a front end portion of the center electrode. The spark plug is characterized in that a protrusion projecting toward the center electrode and forming the gap in cooperation with the front end portion of the center electrode is formed at the distal end portion of the ground electrode from the same material as that used to form the ground electrode, and at least the protrusion has an average crystal grain size of 20 μm to 200 μm inclusive.

Since heat transfer is rather poor at the protrusion, temperature is apt to increase at the protrusion. Therefore, the protrusion, which is formed from the same material as that used to form the ground electrode and is inferior in erosion resistance to a noble metal alloy, may be sharply eroded in association with spark discharges, etc.

Configuration 2: A spark plug for an internal combustion engine according to the present configuration is characterized in that, in the above configuration 1, the protrusion has an average crystal grain size of 50 μm to 200 μm inclusive.

Configuration 3: A spark plug for an internal combustion engine according to the present configuration is characterized in that, in the above configuration 1 or 2, the distal end portion of the ground electrode has an average crystal grain size of 20 μm to 200 μm inclusive.

In the ground electrode, the closer to its distal end, the poorer the heat transfer. Thus, the closer to its distal end, the more likely the increase in temperature. Therefore, the distal end portion of the ground electrode is apt to be eroded in the course of use of an internal combustion engine.

Configuration 4: A spark plug for an internal combustion engine according to the present configuration is characterized in that, in any one of the above configurations 1 to 3, the ground electrode has a bent portion at substantially the middle thereof and the protrusion is greater in average crystal grain size than the bent portion.

Generally, the ground electrode is bent toward the center electrode in order to form a predetermined gap in cooperation with the center electrode. Stress generated in association with operation of an internal combustion engine is apt to concentrate on the bent portion of the ground electrode. Thus, in order to prevent associated breakage of the ground electrode, the bent portion must have sufficient strength.

Configuration 5: A spark plug for an internal combustion engine according to the present configuration is characterized in that, in any one of the above configurations 1 to 4, the protrusion protrudes 0.3 mm to 1.0 mm inclusive toward the center electrode.

Configuration 6: A method of manufacturing a spark plug according to the present configuration is a method of manufacturing a spark plug for an internal combustion engine described in any one of the above configurations 1 to 5. The method is characterized by comprising a heating step of heating the distal end portion of the ground electrode so as to impart an average crystal grain size of 20 μm to 200 μm inclusive to the distal end portion of the ground electrode, and a protrusion forming step of forming the protrusion.

Configuration 7: A method of manufacturing a spark plug according to the present configuration is characterized in that, in the above configuration 6, the protrusion forming step includes a press working step in which a pressing force is applied to the distal end portion of the ground electrode from a side opposite the center electrode for forming the protrusion.

Configuration 8: A method of manufacturing a spark plug according to the present configuration is characterized in that, in the above configuration 7, the press working step is preceded by a heating step of performing heat treatment.

Configuration 9: A method of manufacturing a spark plug according to the present configuration is characterized in that, in any one of the above configurations 6 to 8, the heat treatment in the heating step imparts a Vickers hardness of 80 Hv to 150 Hv inclusive to the distal end portion of the ground electrode.

Effects of the Invention

According to the configuration 1, the distal end portion of the ground electrode has the protrusion formed from the same material as that used to form the ground electrode. Therefore, ignition performance and flame propagation performance can be improved. Also, as compared with the case where a noble metal tip is used to form the protrusion, an increase in manufacturing cost can be restrained.

Further, according to the configuration 1, at the distal end portion of the ground electrode, at least the protrusion has a relatively large average crystal grain size of 20 μm to 200 μm inclusive. Therefore, the protrusion is composed of crystals having an average grain size of at least 20 μm, so that the protrusion allows rapid heat conduction. That is, in the spark plug having the present configuration, the protrusion which protrudes from the body of the ground electrode can exhibit improved heat transfer performance, whereby erosion resistance can be improved without use of a noble metal tip.

When the average crystal grain size is less than 20 μm, heat conductivity deteriorates, so that the above-mentioned actions and effects may not be sufficiently yielded. When the average crystal grain size is in excess of 200 μm, heat transfer performance can be improved. However, intergranular cracking is apt to arise, so that the protrusion may suffer fracture.

According to the configuration 2, the protrusion has an average crystal grain size of 50 μm or greater. Thus, the protrusion allows more rapid heat conduction, so that erosion resistance can be further improved.

According to the configuration 3, the distal end portion of the ground electrode has an average crystal grain size of 20 μm to 200 μm inclusive. Thus, the heat conductivity (heat transfer performance) of the entire distal end portion of the ground electrode can be improved. As a result, erosion resistance can be further improved.

According to the configuration 4, the protrusion is greater in average crystal grain size than the bent portion. In other words, the bent portion has a smaller average crystal grain size (e.g., less than 20 μm). Therefore, the grain boundary strength (mechanical strength) of the bent portion can be improved, so that breakage of the ground electrode at the bent portion can be more reliably prevented.

According to the configuration 5, the protrusion protrudes 0.3 mm or more toward the center electrode from the body of the ground electrode (a flat portion of the ground electrode after removal of the protrusion, etc. formed on the surface of the ground electrode). Therefore, the effect of ignition performance and flame propagation performance being improved through provision of the protrusion is yielded more reliably and effectively. Meanwhile, since the protrusion protrudes from the body of the ground electrode, the erosion resistance of the protrusion may deteriorate. However, since the present configuration 5 specifies the protruding amount of the protrusion to be 1.0 mm or less, such a concern can be ignored.

According to the configuration 6, an average crystal grain size of 20 μm to 200 μm inclusive is imparted to the distal end portion of the ground electrode merely through heat treatment; i.e., without need to perform complicated processing. That is, according to the present configuration, a spark plug having excellent ignition performance and sufficient erosion resistance can be manufactured relatively easily.

According to the configuration 7, the protrusion is formed through press working in which a pressing force is applied to the ground electrode. Therefore, as compared with, for example, the case where the protrusion is formed through cutting, etc., the protrusion can be formed relatively easily without increase in manufacturing cost.

Meanwhile, when the protrusion is formed through press working, as shown in FIG. 2, the path of heat transmission from the protrusion toward the metallic shell is narrowed. Therefore, heat may be less likely to be transferred from the protrusion.

In this regard, through employment of the above configurations, the protrusion has an average crystal grain size of 20 μm to 200 μm inclusive, thereby implementing excellent heat transfer performance. Therefore, even when the protrusion is formed through press working, the protrusion has sufficient erosion resistance. That is, the above configurations are particularly significant for a spark plug in which the protrusion is formed through press working.

According to the configuration 8, the hardness of the ground electrode can be reduced through heat treatment. Thus, press working can be further facilitated in forming the protrusion. As a result, manufacturing efficiency can be improved. Also, wear or the like of working jigs used in press working can be effectively restrained, so that the present configuration is significant also in terms of restraining an increase in manufacturing cost.

According to the configuration 9, the heat treatment reduces the hardness of the distal end portion of the ground electrode to a sufficiently low level of 80 Hv to 150 Hv inclusive in Vickers hardness, whereby formation of the protrusion can be further facilitated. Thus, manufacturing efficiency can be further improved.

DETAILED DESCRIPTION OF THE INVENTION

Figure 1:
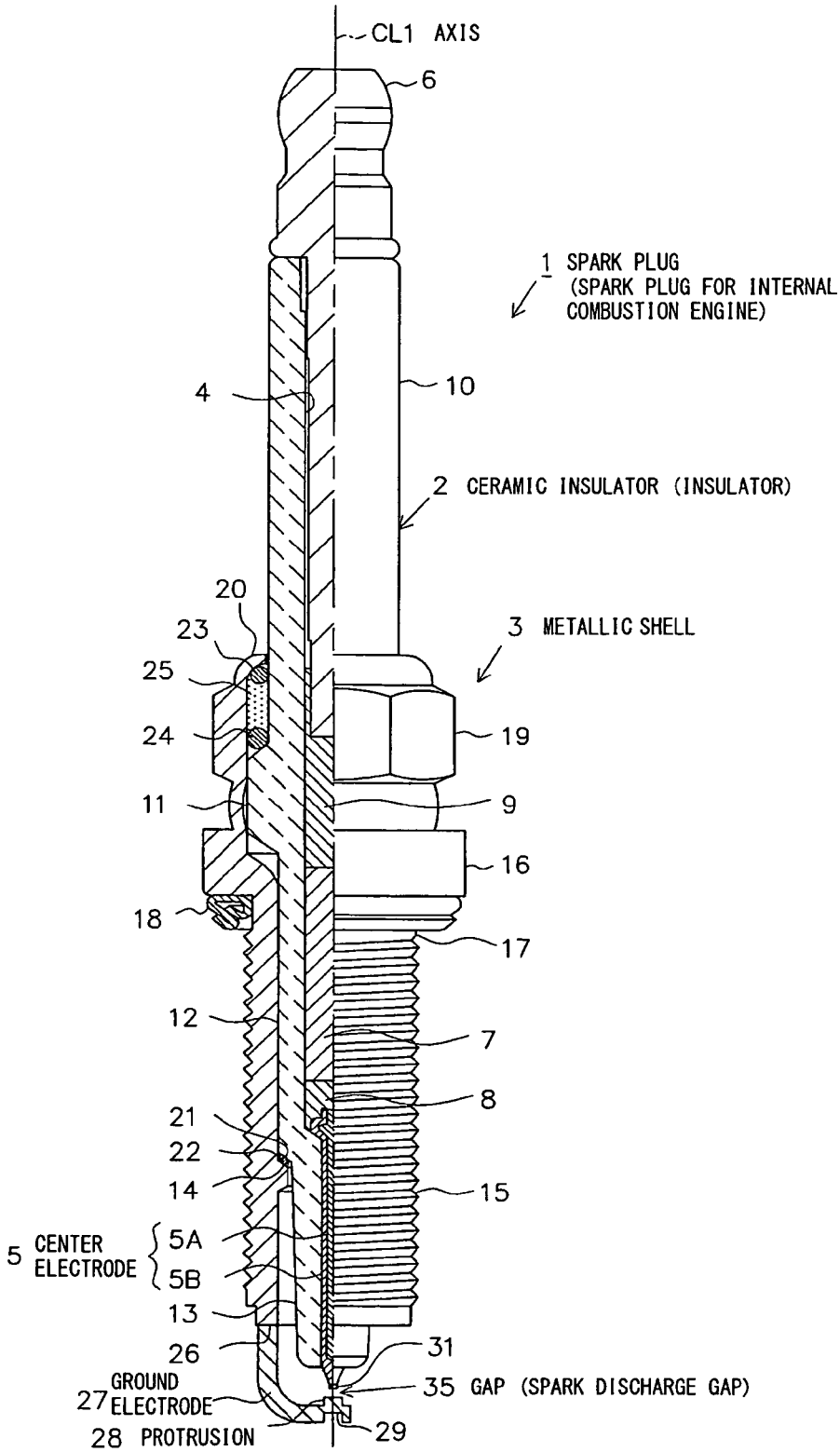
FIG. 1 is a partially cutaway front view showing the configuration of a spark plug according to an embodiment of the present invention.

An embodiment of the present invention will next be described with reference to the drawings. FIG. 1 is a partially cutaway front view showing a spark plug for an internal combustion engine (hereinafter, referred to as a "spark plug") 1. In FIG. 1, the direction of an axis CL1 of the spark plug 1 is referred to as the vertical direction. In the following description, the lower side of the spark plug 1 in FIG. 1 is referred to as the front side of the spark plug 1, and the upper side as the rear side.

The spark plug 1 includes a ceramic insulator 2, which is the tubular insulator in the present invention, and a tubular metallic shell 3, which holds the ceramic insulator 2 therein.

The ceramic insulator 2 is formed from alumina or the like by firing, as well known in the art. The ceramic insulator 2, as viewed externally, includes a rear trunk portion 10 formed on the rear side; a large-diameter portion 11, which is located frontward of the rear trunk portion 10 and projects radially outward; and an intermediate trunk portion 12, which is located frontward of the large-diameter portion 11 and is smaller in diameter than the large-diameter portion 11. The ceramic insulator 2 also includes a leg portion 13, which is located frontward of the intermediate trunk portion 12 and is smaller in diameter than the intermediate trunk portion 12. The leg portion 13 is exposed to a combustion chamber of the internal combustion engine when the spark plug 1 is attached to the internal combustion engine. Additionally, a tapered, stepped portion 14 is formed at a connection portion between the leg portion 13 and the intermediate trunk portion 12. The ceramic insulator 2 is seated on the metallic shell 3 at the stepped portion 14.

Further, the ceramic insulator 2 has an axial hole 4 extending therethrough along the axis CL1. A center electrode 5 is fixedly inserted into a front end portion of the axial hole 4. The center electrode 5 assumes a rodlike (circular columnar) shape as a whole; has a flat front end surface; and projects from the front end of the ceramic insulator 2. The center electrode 5 includes an inner layer 5A made of copper or a copper alloy, and an outer layer 5B made of an Ni alloy which contains nickel (Ni) as a main component. A circular columnar noble metal tip 31 made of a noble metal alloy (e.g., an iridium alloy) is joined to a front end portion of the center electrode 5.

Also, a terminal electrode 6 is fixedly inserted into a rear end portion of the axial hole 4 and projects from the rear end of the ceramic insulator 2.

Further, a circular columnar resistor 7 is disposed within the axial hole 4 between the center electrode 5 and the terminal electrode 6. Opposite end portions of the resistor 7 are electrically connected to the center electrode 5 and the terminal electrode 6 via electrically conductive glass seal layers 8 and 9, respectively.

Additionally, the metallic shell 3 is formed into a tubular shape from a low-carbon steel or a like metal. The metallic shell 3 has, on its outer circumferential surface, a threaded portion (externally threaded portion) 15 adapted to mount the spark plug 1 to an engine head. Also, the metallic shell 3 has, on its outer circumferential surface, a seat portion 16 located rearward of the threaded portion 15. A ring-like gasket 18 is fitted to a screw neck 17 at the rear end of the threaded portion 15. Further, the metallic shell 3 has, near the rear end thereof, a tool engagement portion 19 having a hexagonal cross section and allowing a tool, such as a wrench, to be engaged therewith when the spark plug 1 is to be mounted to the engine head. Also, the metallic shell 3 has a crimp portion 20 provided at a rear end portion thereof for retaining the ceramic insulator 2.

Also, the metallic shell 3 has, on its inner circumferential surface, a tapered, stepped portion 21 adapted to allow the ceramic insulator 2 to be seated thereon. The ceramic insulator 2 is inserted frontward into the metallic shell 3 from the rear end of the metallic shell 3. In a state in which the stepped portion 14 of the ceramic insulator 2 butts against the stepped portion 21 of the metallic shell 3, a rear-end opening portion of the metallic shell 3 is crimped radially inward; i.e., the crimp portion 20 is formed, whereby the ceramic insulator 2 is held by the metallic shell 3. An annular sheet packing 22 intervenes between the stepped portions 14 and 21 of the ceramic insulator 2 and the metallic shell 3, respectively. This retains gastightness of a combustion chamber and prevents outward leakage of air-fuel mixture through a clearance between the inner circumferential surface of the metallic shell 3 and the leg portion 13 of the ceramic insulator 2, which leg portion 13 is exposed to the combustion chamber.

Further, in order to ensure gastightness which is established by crimping, annular ring members 23 and 24 intervene between the metallic shell 3 and the insulator 2 in a region near the rear end of the metallic shell 3, and a space between the ring members 23 and 24 is filled with a powder of talc 25. That is, the metallic shell 3 holds the ceramic insulator 2 via the sheet packing 22, the ring members 23 and 24, and the talc 25.

Also, a ground electrode 27 formed from an Ni alloy or the like is joined to the front end portion 26 of the metallic shell 3. More specifically, the ground electrode 27 is welded at its proximal end portion to the front end portion 26 of the metallic shell 3 and is bent at its substantially middle portion. A spark discharge gap 35, which is the gap in the present invention, is formed between the noble metal tip 31 and a protrusion 28 of the ground electrode 27, which protrusion 28 will next be described. Spark discharges are generated across the spark discharge gap 35 substantially along the direction of the axis CL1.

Figure 2:
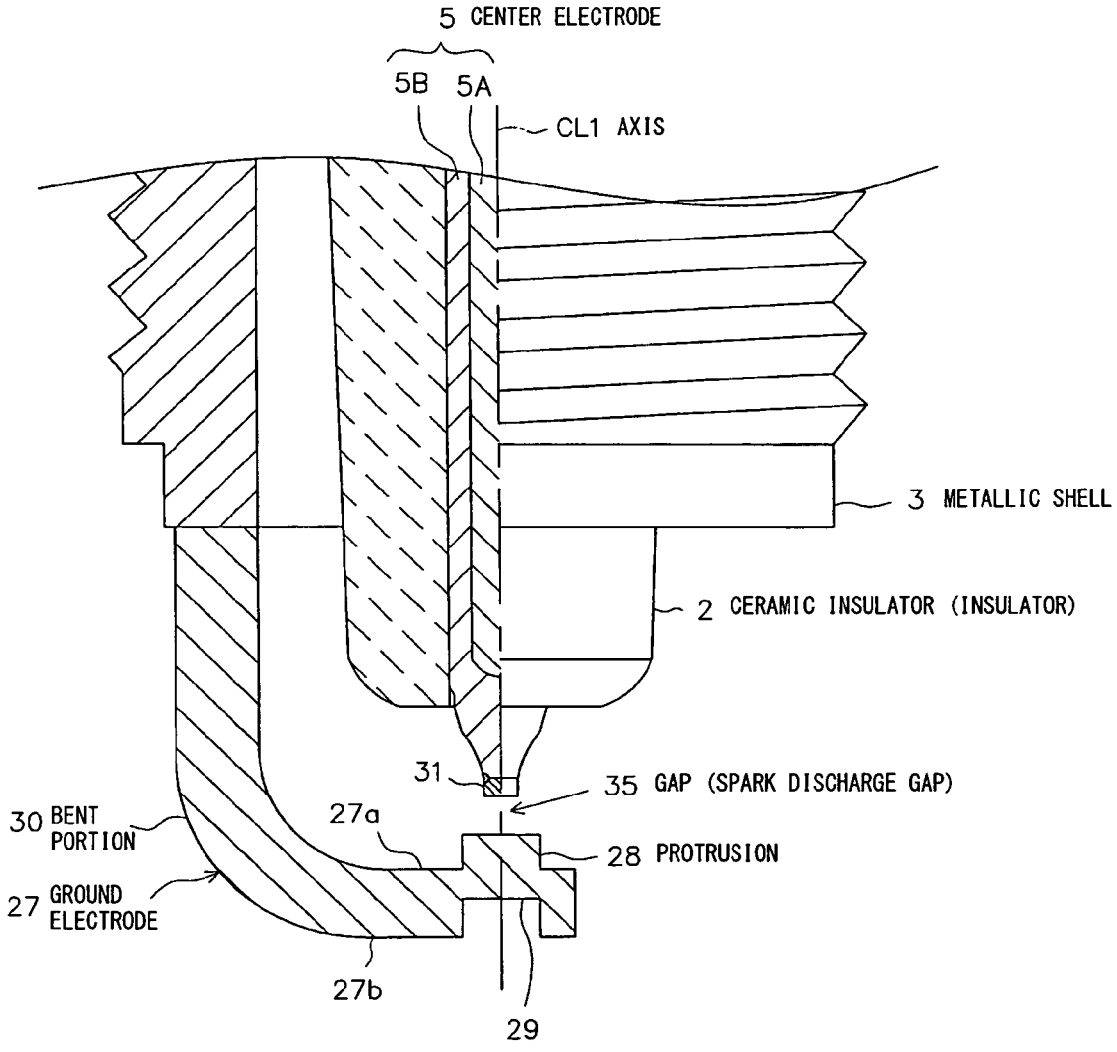
FIG. 2 is a partially cutaway front view showing the configuration of a front end portion of the spark plug.
Figure 3:
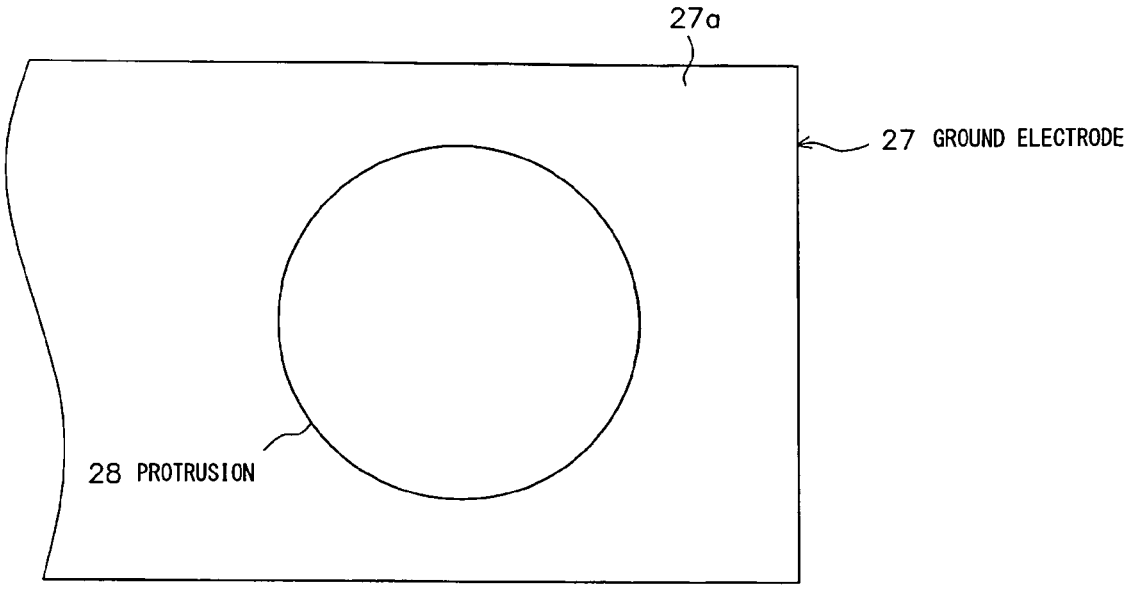
FIG. 3 is a fragmentary enlarged view showing a protrusion.

Also, as shown in FIG. 2, the protrusion 28, which faces the noble metal tip 31, is formed on an inner surface 27*a* of the ground electrode 27. The protrusion 28 protrudes from the inner surface 27*a* of the ground electrode 27 toward the center electrode 5 along the direction of the axis CL1. More specifically, the protrusion 28 protrudes from the inner surface 27*a* of the ground electrode 27 by an amount of 0.3 mm to 1.0 mm inclusive toward the center electrode 5. Also, the protrusion 28 has a circular columnar shape whose cross section taken along a direction orthogonal to the axis CL1 is substantially circular (see FIG. 3).

Additionally, as will be described later, the protrusion 28 is formed by press working in which a pressing force is applied to an outer surface 27*b* of the ground electrode 27. Therefore, a closed-bottomed hole 29 formed in the press working opens in the outer surface 27*b* of the ground electrode 27. A portion of the ground electrode 27 located between the outer circumference of the proximal end of the protrusion 28 and the outer circumference of the bottom of the hole 29 is thinner than the other portion of the ground electrode 27. That is, the path of heat transmission from the protrusion 28 toward the metallic shell 3 is relatively narrowed.

Further, in the present embodiment, a distal end portion of the ground electrode 27 has an average crystal grain size of 20

μm to 200 μm inclusive. Notably, in the present embodiment, the distal end portion of the ground electrode 27 undergoes heat treatment for promoting grain growth in the distal end portion of the ground electrode 27, whereby the distal end portion of the ground electrode 27 has an average crystal grain size of 20 μm to 200 μm inclusive. Thus, the average crystal grain size of the distal end portion of the ground electrode 27 is greater than that (e.g., less than 20 μm) of a bent portion 30 of the ground electrode 27.

The "average crystal grain size" can be measured as follows. The protrusion 28 is cut. Etching is then performed on a cross section of the protrusion 28 (e.g., a cross section located 0.1 mm or more inward from the distal end surface or the side surface of the protrusion 28). The cross section is photographed with such predetermined magnifications (e.g., eighty magnifications) as to allow observation of microstructure. A straight line having a predetermined length (e.g., a straight line having a length of 40 mm; in the case of a magnification of 80 times, the straight line is equivalent to a straight line having a length of 0.5 mm on the unmagnified section) is drawn on the photographed image. Then, crystal grains through which the straight line passes are counted. Subsequently, the predetermined length is divided by the number of the predetermined magnifications to obtain the actual length of the straight line (in the above example, "0.5 mm"). The obtained actual length of the straight line is divided by the counted number of crystal grains, thereby obtaining an average crystal grain size.

Next, a method of manufacturing the spark plug 1 configured as mentioned above is described. First, the metallic shell 3 is formed beforehand. Specifically, a circular columnar metal material (e.g., an iron-based material, such as S17C or S25C, or a stainless steel material) is subjected to cold forging for forming a through hole, thereby forming a general shape. Subsequently, machining is performed so as to adjust the outline, thereby yielding a metallic-shell intermediate.

Subsequently, the ground electrode 27 having the form of a straight rod and formed from an Ni alloy or the like is resistance-welded to the front end surface of the metallic-shell intermediate. The resistance welding is accompanied by formation of so-called "sags." After the "sags" are removed, the threaded portion 15 is formed in a predetermined region of the metallic-shell intermediate by rolling. Thus is yielded the metallic shell 3 to which the ground electrode 27 is welded. The metallic shell 3 to which the ground electrode 27 is welded is subjected to zinc plating or nickel plating. In order to enhance corrosion resistance, the plated surface may be further subjected to chromate treatment.

Separately from preparation of the metallic shell 3, the ceramic insulator 2 is formed. For example, a forming material of granular substance is prepared by use of a material powder which contains alumina in a predominant amount, a binder, etc. By use of the prepared forming material of granular substance, a tubular green compact is formed by rubber press forming. The thus-formed green compact is subjected to grinding for shaping. The shaped green compact is placed in a kiln, followed by firing for forming the insulator 2.

Separately from preparation of the metallic shell 3 and the ceramic insulator 2, the center electrode 5 is formed. Specifically, an Ni alloy prepared such that a copper alloy is disposed in a central portion thereof for enhancing heat radiation is subjected to forging, thereby forming the center electrode 5. Next, the noble metal tip 31 is joined to a front end portion of the center electrode 5 by laser welding or the like.

Then, the ceramic insulator 2 and the center electrode 5, which are formed as mentioned above, the resistor 7, and the terminal electrode 6 are fixed in a sealed condition by means of the glass seal layers 8 and 9. In order to form the glass seal layers 8 and 9, generally, a mixture of borosilicate glass and a metal powder is prepared, and the prepared mixture is charged into the axial hole 4 of the ceramic insulator 2 such that the resistor 7 is sandwiched therebetween. Subsequently, the resultant assembly is heated in a kiln in a condition in which the charged mixture is pressed from the rear by the terminal electrode 6, thereby being fired and fixed. At this time, a glaze layer may be simultaneously fired on the surface of the rear trunk portion 10 of the ceramic insulator 2. Alternatively, the glaze layer may be formed beforehand.

Subsequently, the thus-formed ceramic insulator 2 having the center electrode 5 and the terminal electrode 6, and the thus-formed metallic shell 3 having the ground electrode 27 are assembled together. More specifically, a relatively thin-walled rear-end opening portion of the metallic shell 3 is crimped radially inward; i.e., the crimp portion 20 is formed, thereby fixing together the ceramic insulator 2 and the metallic shell 3.

Next, a distal end portion (including at least a portion where the protrusion 28 is to be formed) of the ground electrode 27 is subjected to heat treatment. Specifically, by use of a radio-frequency induction heating apparatus, the distal end portion of the ground electrode 27 is heated for 10 minutes so as to have a temperature of 1,150° C. as measured with a radiation thermometer. Subsequently, the distal end portion of the ground electrode 27 is gradually cooled. The heat treatment imparts an average crystal grain size of 20 μm to 200 μm inclusive to the distal end portion of the ground electrode 27. Also, the heat treatment anneals the distal end portion of the ground electrode 27, thereby imparting a Vickers hardness of 80 Hv to 150 Hv inclusive to the distal end portion. The heat treatment corresponds to the heating step of the present invention.

Further, the heat-treated distal end portion of the ground electrode 27 is subjected to press working in which, by use of a circular columnar working jig, a pressing force is applied to the distal end portion from a side opposite the center electrode 5, thereby forming the protrusion 28 and the hole 29. The press working corresponds to the press working step of the present invention.

Finally, the ground electrode 27 is bent toward the center electrode 5, and the magnitude of the spark discharge gap 35 between the protrusion 28 and the center electrode 5 (tip 31) is adjusted, thereby yielding the spark plug 1.

As described in detail above, according to the present embodiment, the distal end portion of the ground electrode 27 has the protrusion 28 formed from the same material as that used to form the ground electrode 27. Therefore, ignition performance and flame propagation performance can be improved. Also, as compared with the case where a noble metal tip is used to form the protrusion, an increase in manufacturing cost can be restrained.

Also, at the distal end portion of the ground electrode 27, at least the protrusion 28 has a relatively large average crystal grain size of 20 μm to 200 μm inclusive. Therefore, the protrusion 28 which protrudes from the body of the ground electrode 27 can exhibit improved heat transfer performance, whereby erosion resistance can be improved without use of a noble metal tip.

Further, the average crystal grain size of the distal end portion of the ground electrode 27, at least the protrusion 28, is greater than that of the bent portion 30. In other words, the bent portion 30 has a smaller average crystal grain size. Therefore, the grain boundary strength (mechanical strength)

of the bent portion 30 can be improved, so that breakage of the ground electrode 27 at the bent portion 30 can be more reliably prevented.

Also, the protrusion 28 protrudes 0.3 mm or more toward the center electrode 5 from the inner surface 27*a* of the ground electrode 27. Therefore, the effect of ignition performance and flame propagation performance being improved through provision of the protrusion 28 is yielded more reliably and effectively. Meanwhile, since the protruding amount of the protrusion 28 is specified to be 1.0 mm or less, erosion resistance can be improved more reliably.

Additionally, as for the manufacturing method, according to the present embodiment, an average crystal grain size of 20μ to 200 μm inclusive is imparted to the distal end portion of the ground electrode 27 merely through heat treatment without need to perform complicated processing. That is, the spark plug 1 having excellent ignition performance and sufficient erosion resistance can be manufactured relatively easily.

Also, since the protrusion 28 is formed through the ground electrode 27 being subjected to press working, as compared with, for example, the case where the protrusion 28 is formed through cutting, etc., the protrusion 28 can be formed relatively easily without increase in manufacturing cost. Meanwhile, when the protrusion 28 is formed through press working, heat may be less likely to be transferred from the protrusion 28. However, as mentioned above, since the distal end portion of the ground electrode 27 has an average crystal grain size of 20 μm to 200 μm inclusive, even when the protrusion 28 is formed through press working, sufficient erosion resistance is ensured.

Also, since press working is performed on the distal end portion of the ground electrode 27 whose hardness is reduced through heat treatment to a Vickers hardness of 80 Hv to 150 Hv inclusive, the protrusion 28 can be formed more easily. As a result, manufacturing efficiency can be improved. Also, by means of the hardness of the distal end portion of the ground electrode 27 being reduced, wear or the like of working jigs used in press working can be effectively restrained, so that the reduction of the hardness is significant also in terms of restraining an increase in manufacturing cost.

Figure 4:
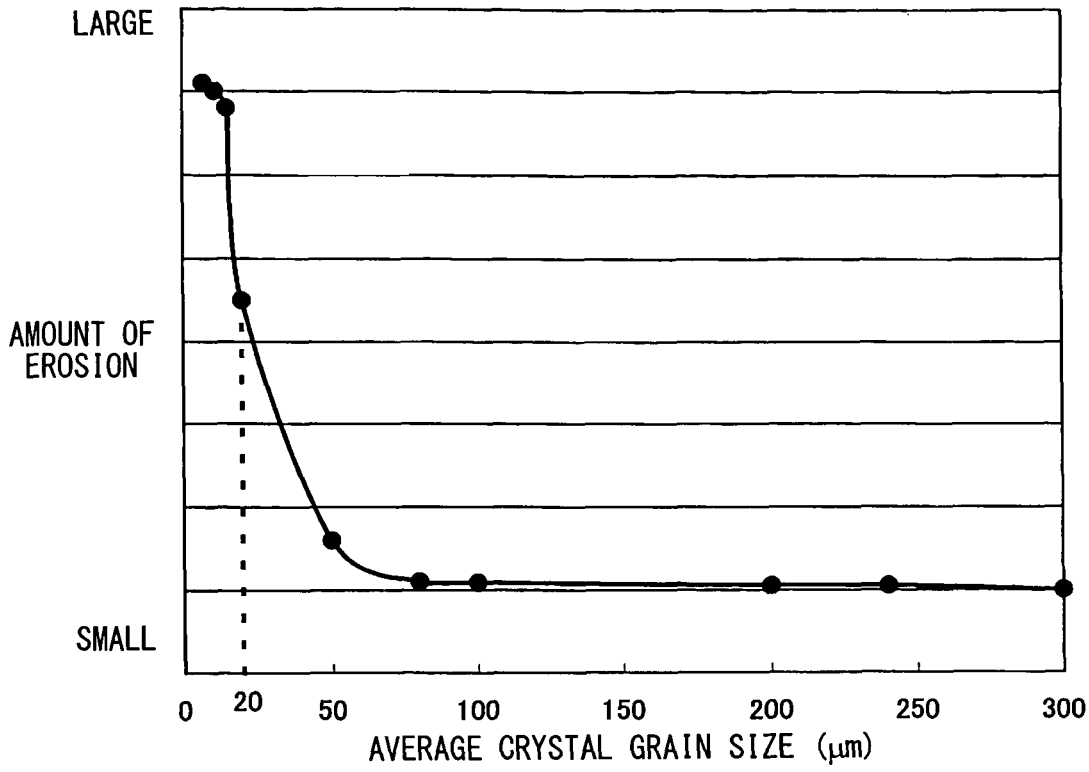
FIG. 4 is a graph showing the relation between the average crystal grain size of the protrusion and the amount of erosion of the protrusion in a durability evaluation test.

Next, in order to verify the effects yielded by the present embodiment, there were fabricated spark plug samples whose ground electrodes differed in the average crystal grain size of the front end portion (protrusion). The samples were subjected to a durability evaluation test. The outline of the durability evaluation test is as follows. The samples were mounted to a 4-cylinder engine with a displacement of 2,000 cc. The engine was run for 100 hours with full throttle opening (rotational speed: 5,600 rpm). After the elapse of 100 hours, the samples were measured for the amount of erosion of the protrusion and were examined for a fracture of the protrusion. FIG. 4 shows the relation between the average crystal grain size of the protrusion and the amount of erosion of the protrusion. Table 1 shows the relation between the average crystal grain size of the protrusion and whether or not a fracture exists in the protrusion. Criteria for judgment appearing in Table 1 (provided below) are as follows: "A" in the case where no facture exists in the protrusion, indicating that strength is excellent; and "B" in the case where a fracture exists in the protrusion, indicating that strength is insufficient.

As shown in FIG. 4, the samples whose protrusions have an average crystal grain size of less than 20 μm show relatively large amounts of erosion of the protrusions, indicating that erosion resistance is insufficient.

By contrast, the samples whose protrusions have an average crystal grain size of 20 μm or greater show effective restraint of erosion of the protrusions, indicating that the samples have excellent erosion resistance. Conceivably, this stems from the following: relatively large grain sizes are imparted to crystals which constitute the protrusions, whereby the heat conductivities of the protrusions are improved. Also, the samples whose protrusions have an average crystal grain size of 50 μm or greater show further restraint of erosion of the protrusions. Further, the samples whose protrusions have an average crystal grain size of 100 μm or greater have quite excellent erosion resistance.

TABLE 1

| | Average crystal grain size (μm) | | | | | | | | | | |
|---|---|---|---|---|---|---|---|---|---|---|---|
| | 10 | 20 | 34 | 50 | 64 | 80 | 100 | 200 | 240 | 300 | 360 |
| Judgment | A | A | A | A | A | A | A | A | B | B | B |

As shown in Table 1, the samples whose protrusions have an average crystal grain size in excess of 200 μm carry risk for fracture of the protrusions. By contrast, the samples whose protrusions have an average crystal grain size of 200 μm or less are free from fracture of the protrusions, indicating that the samples have excellent strength.

The above test results have revealed the following. In view of achieving excellent erosion resistance, an average crystal grain size of the protrusion of 20 μm to 200 μm inclusive is preferred. In view of achieving quite excellent erosion resistance, an average crystal grain size of the protrusion of 50 μm to 200 μm inclusive is more preferred, and an average crystal grain size of the protrusion of 100 μm to 200 μm inclusive is far more preferred.

The present invention is not limited to the above-described embodiment, but may be embodied, for example, as follows. Of course, applications and modifications other than those exemplified below are also possible.

(a) In the above embodiment, the distal end portion of the ground electrode 27 has an average crystal grain size of 20 μm to 200 μm inclusive. However, it suffices that at least the protrusion 28 has an average crystal grain size of 20 μm to 200 μm inclusive.

Figure 5:
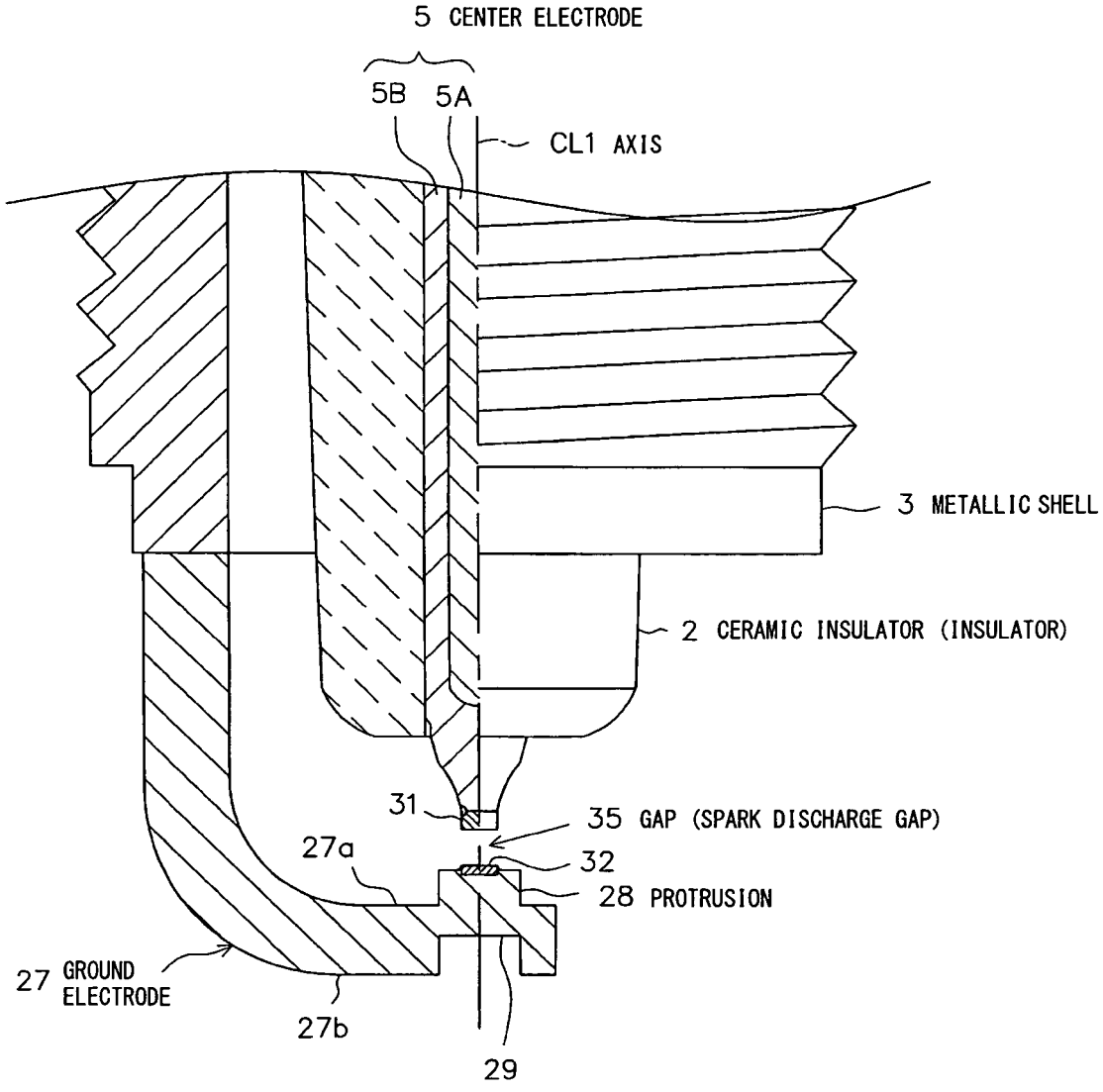
FIG. 5 is a partially cutaway front view showing the form of a protrusion in another embodiment of the present invention.

(b) In the above embodiment, the noble metal tip 31 is provided at the front end portion of the center electrode 5. However, the noble metal tip 31 may be eliminated. Meanwhile, as shown in FIG. 5, a noble metal tip 32 may be provided on the distal end surface of the protrusion 28 of the ground electrode 27. The provision of the noble metal tip 32 on the protrusion 28 further improves erosion resistance. In the case where the noble metal tip 32 is provided on the distal end surface of the protrusion 28, the protrusion 28 (noble metal tip 32) may protrude about 1.5 mm from the inner surface 27*a* of the ground electrode 27. This configuration further improves ignition performance. The noble metal tip 32 is relatively thin and is not intended to serve as the protrusion 28.

(c) In the above embodiment, the protrusion 28 is formed through press working in which a pressing force is applied to the outer surface 27*b* of the ground electrode 27. The method of forming the protrusion 28 is not limited thereto. For example, a jig having a recess corresponding to the shape of the protrusion 28 may be pressed against the inner surface 27*a* of the ground electrode 27 for forming the protrusion 28. Alternatively, the protrusion 28 may be formed through cutting.

(d) The heat treatment conditions of the above embodiment are a mere example. Heat treatment may be performed under other conditions. For example, heat treatment may be performed at a lower temperature (e.g., 1,000° C.) for a longer time (e.g., one hour).

(e) In the above embodiment, the distal end portion of the ground electrode 27 is first subjected to heat treatment and then to press working, thereby forming the protrusion 28. On the contrary, after press working, the distal end portion (protrusion 28) of the ground electrode 27 may be subjected to heat treatment for having an average crystal grain size of 20 μm to 200 μm inclusive.

(f) In the above embodiment, the protrusion 28 has a circular columnar shape. However, the shape of the protrusion 28 is not limited thereto. For example, the protrusion 28 may be formed into a shape having a polygonal cross section, such as a rectangular cross section or a hexagonal cross section.

Figure 6:
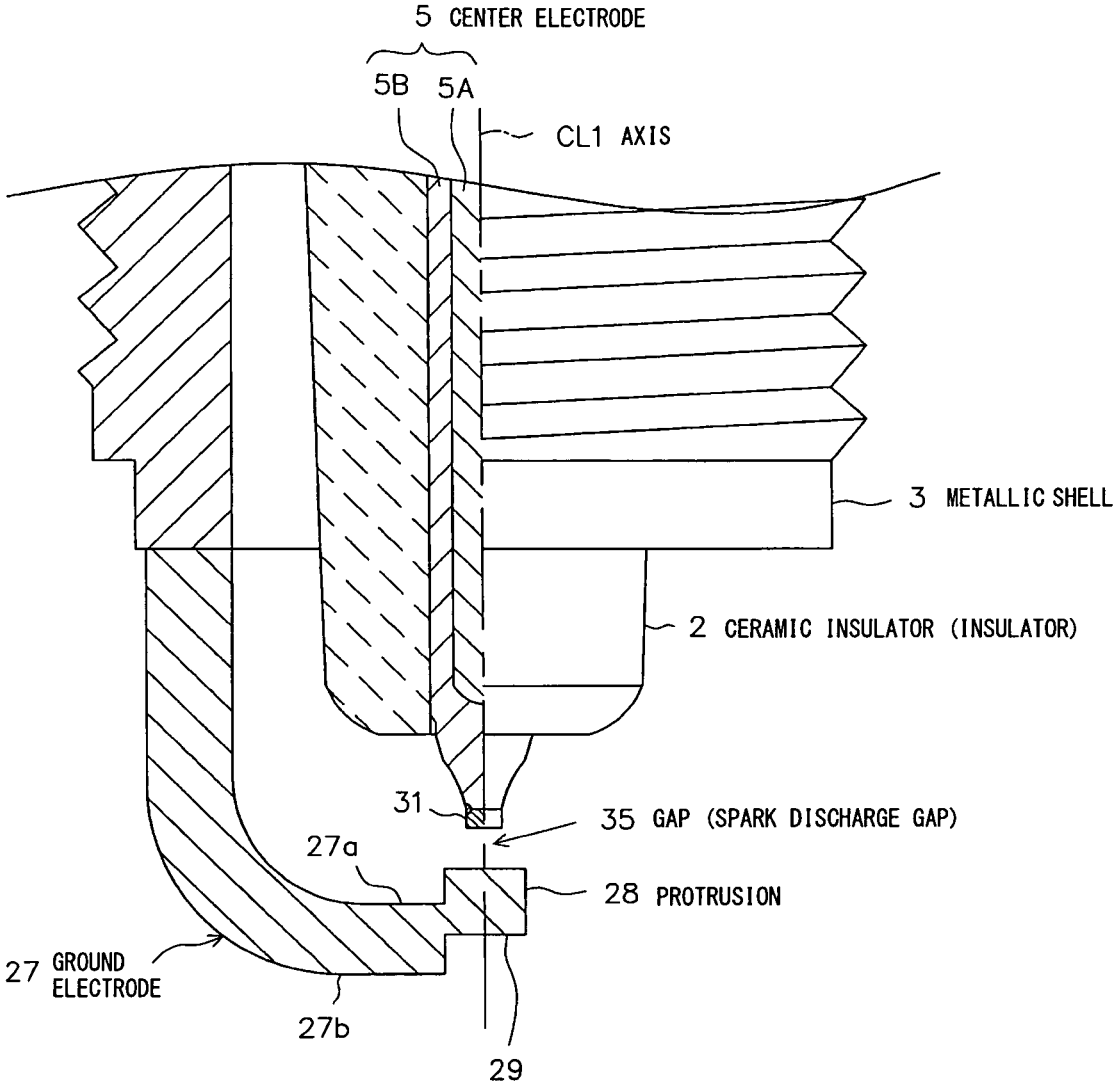
FIG. 6 is a partially cutaway front view showing the form of a protrusion in still another embodiment of the present invention.

(g) The position on the ground electrode 27 where the protrusion 28 is formed is not limited to that in the above embodiment. For example, as shown in FIG. 6, the protrusion 28 may be formed flush with the distal end of the ground electrode 27.

(h) According to the above embodiment, the ground electrode 27 is joined to the front end surface of the front end portion 26 of the metallic shell 3. However, the present invention is applicable to the case where a portion of a metallic shell (or a portion of an end metal piece welded beforehand to the metallic shell) is cut to form a ground electrode (for example, see Japanese Patent Application Laid-Open (kokai) No. 2006-236906). Also, the ground electrode 27 may be joined to a side surface of the front end portion 26 of the metallic shell 3.

(i) In the above embodiment, the tool engagement portion 19 has a hexagonal cross section. However, the shape of the tool engagement portion 19 is not limited thereto. For example, the tool engagement portion 19 may have a Bi-HEX (modified dodecagonal) shape [IS022977:2005(E)] or the like.

DESCRIPTION OF REFERENCE NUMERALS

1: spark plug (spark plug for internal combustion engine);
2: ceramic insulator (insulator for spark plug);
3: metallic shell;
4: axial hole;
5: center electrode;
27: ground electrode;
28: protrusion;
30: bent portion; and
35: spark discharge gap (gap).

Having described the invention, the following is claimed:

1. A spark plug for an internal combustion engine comprising:

a rodlike center electrode extending in a direction of an axis;

a substantially cylindrical insulator provided externally of an outer circumference of the center electrode;

a substantially cylindrical metallic shell provided externally of an outer circumference of the insulator; and a ground electrode extending from a front end portion of the metallic shell and forming a gap between a distal end portion thereof and a front end portion of the center electrode;

wherein a protrusion projecting toward the center electrode and forming the gap in cooperation with the front end portion of the center electrode is formed at the distal end portion of the ground electrode from the same material as that used to form the ground electrode, at least the protrusion has an average crystal grain size of 20 μm to 200 μm inclusive, the ground electrode has a bent portion at substantially the middle thereof, and the protrusion is greater in average crystal grain size than the bent portion.

2. A spark plug for an internal combustion engine according to claim 1, wherein the protrusion has an average crystal grain size of 50 μm to 200 μm inclusive.

3. A spark plug for an internal combustion engine according to claim 1, wherein the distal end portion of the ground electrode has an average crystal grain size of 20 μm to 200 μm inclusive.

4. A spark plug for an internal combustion engine according to claim 1, wherein the protrusion protrudes 0.3 mm to 1.0 mm inclusive toward the center electrode.

5. A method of manufacturing a spark plug for an internal combustion engine having a rodlike center electrode extending in a direction of an axis; a substantially cylindrical insulator provided externally of an outer circumference of the center electrode; a substantially cylindrical metallic shell provided externally of an outer circumference of the insulator; and a ground electrode extending from a front end portion of the metallic shell and forming a gap between a distal end portion thereof and a front end portion of the center electrode; wherein a protrusion projecting toward the center electrode and forming the gap in cooperation with the front end portion of the center electrode is formed at the distal end portion of the ground electrode from the same material as that used to form the ground electrode, at least the protrusion has an average crystal grain size of 20 μm to 200 μm inclusive, and the ground electrode has a bent portion at substantially the middle thereof, said method comprising:

a heating step of heating the distal end portion of the ground electrode so as to impart an average crystal grain size of 20 μm to 200 μm inclusive to the distal end portion of the ground electrode, and a protrusion forming step of forming the protrusion, wherein the protrusion is greater in average crystal grain size than the bent portion.

6. A method of manufacturing a spark plug for an internal combustion engine according to claim 5, wherein the protrusion forming step includes a press working step in which a pressing force is applied to the distal end portion of the ground electrode from a side opposite the center electrode for forming the protrusion.

7. A method of manufacturing a spark plug for an internal combustion engine according to claim 6, wherein the press working step is preceded by the heating step of performing heat treatment.

8. A method of manufacturing a spark plug for an internal combustion engine according to claim 5, wherein the heat treatment in the heating step imparts a Vickers hardness of 80 Hv to 150 Hv inclusive to the distal end portion of the ground electrode.

* * * * *